US007159380B2

(12) United States Patent
Issakides

(10) Patent No.: US 7,159,380 B2
(45) Date of Patent: Jan. 9, 2007

(54) TIE YARN FOR INCANDESCENT BODIES AND THE USE THEREOF

(76) Inventor: Georg Issakides, Fleischmarkt 26, AT-1010 Wien, Osterreich (AT)

( * ) Notice: Subject to any disclaimer, the term of this patent is extended or adjusted under 35 U.S.C. 154(b) by 0 days.

(21) Appl. No.: 10/487,632

(22) PCT Filed: Aug. 20, 2002

(86) PCT No.: PCT/EP02/09291

§ 371 (c)(1),
(2), (4) Date: Aug. 18, 2004

(87) PCT Pub. No.: WO03/018889

PCT Pub. Date: Mar. 6, 2003

(65) Prior Publication Data

US 2004/0258908 A1 Dec. 23, 2004

(30) Foreign Application Priority Data

Aug. 24, 2001 (DE) ..... 101 40 654
Dec. 5, 2001 (DE) ..... 101 59 530

(51) Int. Cl.
*D02G 3/02* (2006.01)
*D02G 3/32* (2006.01)

(52) U.S. Cl. ..... 57/245; 57/246

(58) Field of Classification Search ..... 57/208, 57/227, 245, 246, 254
See application file for complete search history.

(56) References Cited

U.S. PATENT DOCUMENTS 4,549,187 A * 10/1985 Levy ..... 343/897
5,116,220 A 5/1992 Kinzel
5,639,231 A 6/1997 May
5,701,730 A * 12/1997 Kennedy et al. ..... 57/224
5,771,674 A * 6/1998 Smith et al. ..... 57/284
6,841,242 B1 * 1/2005 Molins ..... 428/357

* cited by examiner

*Primary Examiner*—Shaun R. Hurley
(74) *Attorney, Agent, or Firm*—Donn K. Harms

(57) ABSTRACT

The invention relates to an asbestos-free binding yarn for fastening incandescent bodies to burners of incandescent lamps whose incandescent bodies after the fastening are exposed to a flame, wherein the binding yarn consists of a fireproof material, preferably silica yarn. For improving the knotting ability of the yarn it is envisaged that the binding yarn after exposure in the flame has a diameter changed of less that 50% of its original diameter. The subject-matter of the invention is also the use of the binding yarn on an incandescent body for increasing its retention and durability.

20 Claims, 6 Drawing Sheets

TIE YARN FOR INCANDESCENT BODIES AND THE USE THEREOF

FIELD OF THE INVENTION

The invention relates to an asbestos-free binding yarn for fastening incandescent bodies to burners of incandescent lamps, whose incandescent bodies are exposed to a flame after fastening, wherein the binding yarn consists of fireproof material and comprises a finish increasing the skin friction of the material.

Apart from the number of sewing stitches with which the binding yarn is sewn into the incandescent body fabric, wherein as the case may be, one sews through both layers of fabric if the end of the fabric hose or bag has been turned up, it is above all the nature of the binding yarn which is significant for the mechanical durability of an incandescent body on the burner of an incandescent lamp. The selection of the binding yarn is subject to various criteria. It must be resistant to high temperatures, must retain its textile properties at a high temperature and become neither hard nor brittle. This is to say a yarn of steel is of no use, and the knot must endure well.

BACKGROUND OF THE INVENTION

In the past, asbestos yarn was the only binding yarn to be used with incandescent bodies. This yarn was enduring at high temperatures and could be easily knotted. It however has the disadvantageous characteristic that it is damaging to health and has therefore been prohibited in many countries. The disadvantageous properties of asbestos, in particular the limited usability on account of its prohibition has led to the search and application of new binding yarns.

Thus it has been attempted to use cotton yarn which is impregnated in metal salts, e.g. of rare earths. During the burning-away of the incandescent body, the cotton burns without any residue and an oxide skeleton in the form of a yarn remains. The skeleton is likewise enduring at high temperatures and in the original condition the yarn may be easily knotted. The disadvantageous property lies in the fact that after the burning-away of the incandescent body only the oxide skeleton arising from the impregnation salts remains, which has no tear strength and may not hold the incandescent body on the burner for a long time. This yarn therefore was hardly used in practice.

Binding yarns based on glass fiber, ceramics, organic materials, e.g. aramide, carbon fibers etc. are also known. The endurance at high temperature is counted amongst the advantageous properties. However, at the same time there are also disadvantages. These yarns have such a smooth and such a friction-free surface that they are difficult to knot or the knot easily becomes undone. (A knot only holds on account of the friction). With a low Tex number there is a low tear strength, poor processing ability, e.g. on sewing, cutting, etc.

Common binding yarns from which the invention proceeds consist of a glass fiber or ceramic core or a silica core of approx. 0.2 mm diameter enveloped with cotton of stack fibers according to the International patent application PCT/GB92/00432 so that there results a total diameter of approx. 0.5 mm.

These have a silica yarn core enduring at high temperatures and may be knotted since the smooth silica yarn is sheathed to excess with non-smooth cotton yarn, which overcomes the smoothness and renders the knot lasting. They are tear-resistant and may be easily processed. The disadvantage with these is the fact that the incandescent body which is originally rigidly attached to the burner, after the burning-away of the incandescent body, is seated loosely on the burner, by which means the mechanical durability on the burner is reduced. The initially tight knot is likewise loose after the burning-away of the wrapped winding. The manufacture is effected in an expensive DREF machine and the yarn is therefore very expensive. Furthermore, it is often the case that as a result of operational trouble the core is no longer co-conveyed, but the production continues to run. Such errors may not however be recognized by optical control so that after burning-away the binding yarn has disappeared and the incandescent body falls down.

Finally instead of a binding yarn, a round metal clip according to U.S. Pat. No. 5,116,220 and U.S. Pat. No. 5,639,231 are used. The metal clip is sewn into the incandescent body at the height at which the binding yarn would have been sewn in. This metal clip is enduring at high temperature and is operationally friendly since the user does not need to tie any yarn. The connection between the incandescent body and the burner does not have the same compactness, as is the case with the binding yarn. The incandescent body does not perfectly contact the burner (see U.S. Pat. No. 5,639,231). The lack of retention of the incandescent body on the burner is the price to pay for the operational friendliness of the metal clip.

It is therefore the object of the invention to provide an operationally friendly yarn which may be easily knotted and furthermore increases the application duration and durability of an incandescent hood subjected to knocks and impacts.

SUMMARY OF THE INVENTION

An asbestos-free binding yarn for fastening incandescent bodies to burners of incandescent lamps, whose incandescent bodies are exposed to a flame after the fastening, wherein the binding yarn consists of a fireproof material and comprises a finish increasing the skin friction value of the material, achieves this object in that the binding yarn has a diameter change after exposure in the flame of less than 50% of its original diameter. It has been surprisingly found out that the reduction of the diameter shrinkage on burning-away significantly contributes to the increase in the life expectancy of the incandescent hood. In trials with which the burnt-off incandescent hood is subjected to an impact loading or oscillation loading, an increase of the life expectancy of threefold with respect to incandescent hoods which were fastened with yarn according to the state of the art was ascertained. In this context, yarn is to be understood as any ductile one-dimensional body, thread, yarn or tape. With tapes, the thickness replaces the diameter.

In one advantageous embodiment of the invention it is envisaged that the yarn consists of a fireproof material which is knitted, braided or spun with itself. By way of this, staple fibers may be advantageously done away with by which means one further requires no expensive DREF machine.

The knotting ability of the binding yarn as well as the life duration of the incandescent hood may further be improved in that the binding yarn is textured. It has been surprisingly found out that a texturing of the binding yarn significantly contributes to an increase in the life expectation of the incandescent hoods. In trials with which the burnt-off incandescent hood is subjected to an impact loading or to an oscillation loading, there resulted an increase of the durability of up to threefold with respect to incandescent hoods which were fastened with yarn according to the state of the art. In this context yarn is to be understood as a ductile, one-dimensional body, thread, yarn or tape. Texturing is to be understood as various methods which increase the smooth structureless filaments in volume. Smooth yarns are for example crimped in a lasting manner, and thus so-called crimp yarn, crimp twine, textured yarn, stretch yarn arises, whose extensibility is increased on account of its spun-yarn-like appearance.

A yarn, in particular a silicate yarn which is textured by way of a nozzle blower method has shown to be particularly suitable.

For an improved knotting ability it is advantageous if the yarn has an etched surface. The type of yarn is not limited; all high-temperature yarns with a smooth surface without exception are considered, such as yarns of glass fibers, carbon fibers or mineral fibers or any mixtures of these. The etching may for example, be effected with hydrofluoric acid. A significant shrinkage of the diameter advantageously does not take place so that the incandescent body has an increased service life. The high-temperature yarn, e.g. silica yarn amongst others is etched in hydrofluoric acid, subsequently washed and dried.

In one advantageous alternative embodiment of the invention it is envisaged that the yarn is enveloped by a layer of combustible material, preferably is wound around, knitted around, woven around or spun around by endless filaments or endless yarns.

Such a layer may be manufactured in a particularly economical manner if the layer consists of a plastic, preferably a polymer. A plastic polymer or a natural polymer is added to the high-temperature yarn and the smooth surface of the original yarn is coated with this. Monomers or pre-polymers are added to the high temperature yarn which are subsequently polymerized so that amongst other things one may achieve effects. Examples of such polymers are polyacrylates, polymethacrylate, casein, polyacrylnitrile, and latex, but also polymers which are to be indicated as high temperature polymers on account of their properties. The refined yarns may be manufactured with simple means and with various methods. This may be effected by impregnating, mechanical addition or spraying of the yarn and subsequent drying, etc. The chemical refining only slightly changes the Tex number of the raw yarn so that the disadvantages of the yarn according to the state of the art do not arise. The incandescent body manufactured with the new yarn described here has a greater mechanical retention ability on the burner than with incandescent bodies manufactured with known yarn since also after the burning-away of the incandescent body, the yarn is just as firmly connected to the burner than before the burning-away. For chemical bonding one may also add textile additives such as softeners, surface-active substances, etc. The special yarn manufactured in this manner may further be subjected to reviving. The applied chemical compound either burns without residue or the residue in its quantity is so low that it does not adversely affect the performance of the incandescent body. The possibility of coloring the yarn is of a great significance. This may be effected by the addition of a dye for dissolving or a dispersion in which the chemical compound is located.

If the yarn consists of several fiber strands, preferably 2 to 3, preferably twisted fiber strands which in particular have a length-related mass of 170 Tex per fiber strand, then this may be easily impregnated with such plastics. The yarn treated in this manner, if it consists of a number of filaments and possibly also stack fibers, by way of chemical refinement becomes a compact unit and behaves like a thread, by which means the processing ability (sewing ability, cutting ability, processing by machine etc.) is simplified and improved.

In a further advantageous embodiment the yarn may have a woven, knitted or spun outer surface. By way of this surface structure produced by these processes, the friction is already reduced so much that the yarn may be easily knotted.

If the yarn consists of a mixture of fireproof materials and combustible fibers, wherein preferably the share of fireproof fibers is larger or equal to 60 percent by volume, this already leads to the desired increase in life expectation even if a part burns away.

By way of the measure that the diameter of the combustible fibers is designed smaller than the diameter of the fireproof fibers and preferably the combustible fibers are arranged filling the interstices of the fireproof fibers, the shrinkage in diameter is additionally reduced.

The invention furthermore relates to the specified use of binding yarn on an incandescent body, which consists of a tissue hose or bag with at least one open end, wherein in each case a fireproof fastening material is provide for fastening the bag ends on a burner or on a shape part for a burner of an incandescent lamp.

Such incandescent bodies consist of a substrate material which is knitted in a round manner. Viscose is generally used to which metal salts are added. The incandescent body is usually attached with a binding yarn either directly on a burner but also firstly on a pre-manufactured shape part for the burner (the shape part with the fastened incandescent body is placed onto the burner by the end consumer) and subsequently burnt away and brought to radiate in the gas flame.

With this the substrate material burns away completely and only the oxide skeleton of the metal salts remain. Low mechanical loading is already sufficient to destroy it. If now this oxide skeleton is subjected to impact and vibration, as e.g. with the transport of the lamp or with careless handling, then the incandescent body is destroyed usually at its weakest location, specifically at the burner.

For increasing the mechanical durability of the incandescent body on the burner the following methods are known in the state of the art.

One method lies in reinforcing the tissue at the contact location to the burner. In order to reinforce the oxide skeleton at its contact location to the burner, the tissue is turned up in the region of the burner and is chemically reinforced in this region and is thus present double. The tissue and the oxide skeleton remaining after the burning-away now consist of two plies which are chemically reinforced. This double-ply oxide skeleton increases the time of the intact retention of the incandescent body on the burner on exposure to knocks and impacts.

A further way lies in the selection of the binding yarn with which the incandescent body is bonded on the burner. A yarn is sewn into the tissue in order to attach the incandescent body on the burner. Different burners require a different ending of the binding yarn. With the remaining fastening method, on production, a yarn is drawn into the fastening opening, or into the two fastening openings of the incandescent body with more or less many stitches, whereupon the end consumer then pulls the incandescent body either on a ceramic ring or an elongate one-part or two-part burner and tightly pulls the ends of the yarn together and ties them with a knot.

For other burner types the incandescent body is drawn together and pre-knotted already during the production procedure, wherein the diameter of the opening remaining in this manner is prescribed exactly to a tenth of a millimeter.

The fastening material surprisingly has an influence on the durability of the incandescent body. The binding yarn is the most common worldwide fastening method of the incandescent body.

By way of the fact that the binding yarn according to one or more of the claims 1 to 11 are used for fastening an incandescent body of the above described manner, the application duration and mechanical stability of the incandescent body increases. In order to test the mechanical durability of the incandescent body, the burnt-away incandescent body together with the burner are attached to a jolting machine and jolted for so long until the incandescent body is damaged. The jolt time is a measure for the control of the mechanical durability with respect to knocks and impacts. The incandescent bodies manufactured according to the present invention surprisingly have extended durability and serviceable life by more than threefold. On being subjected to knocks, impacts and vibrations the incandescent body in the context of the invention has a completely different nature than the conventional incandescent body. The conventional incandescent body is destroyed in that the oxide skeleton successively separates away from the binding yarn until it is no longer held by this and falls down from the burner. If the incandescent body manufactured according to the invention is subjected to knocks, impact and vibration, then the oxide skeleton no longer separates from the binding yarn and by way of this is held on the burner for a considerably longer time. This incandescent body below the fastening and specifically in the incandescent body itself is destroyed so that the durability of this is only dependent on the nature of the oxide skeleton from which the incandescent body is manufactured, and from the design of the burner.

The preferably textured fastening material connected to the incandescent body, if the incandescent body is subjected to knocks, impacts and vibrations, thus serves as a protective medium which protects the oxide skeleton from separating from the fastening material. This fastening material may be worked in as a thread for example as follows:

a. It is worked into the incandescent body tissue with stitches (similar to how the binding yarn is sewn in).

b. In the region of the opening it is worked in around and through the incandescent body tissue in the manner of a loop. There may be several loops which are continuously incorporated, or, also individually and separate ones which are attached at various locations along the opening, and may each be individually knotted.

c. It may be incorporated into the device in a manner such that it is suspended only on the binding medium on the inner side of the incandescent body in the region of the burner by way of the most varied of stitches (e.g. buttonhole stitch)

d. It is fastened on the inner side of the incandescent body in the region of the burner (e.g. by way of gluing or adhering).

e. On the knitting machine in the knitting procedure of the substrate material (usually viscose) it is incorporated in the incandescent body tissue at least in the region of the burner.

With this, in a further embodiment of the invention it is envisaged that the binding yarn is guided through the tissue bag forming a loop over the periphery of the tissue bag. The at least one loop or loops need not necessarily be present already in the unfastened condition but may be formed not until on fastening to the burner. The loops neither need to be closed but may for example also be present as a meander.

A further increase in the durability may be achieved if the binding yarn is led in a noosed manner around the end of the tissue bag. In this fashion the formed nooses simultaneously reinforce the tissue end. The binding yarn itself after it has been sewn in around the incandescent body according to the usual method may once again be worked in around or along the opening of the incandescent body and by way of this becomes a protective medium with the second turn.

The incandescent body need only be slightly modified in order to achieve the advantages according to the invention if the binding yarn is arranged in a penetrating manner at a distance to the end of the tissue bag, wherein it is fastened on the tissue bag such that on tightening it forms loops. With this design one may advantageously do away with additional spacer bodies or threads. The binding yarn itself acts itself as a spacer body by way of the loops being formed. For example the binding yarn itself after it has been sewn in around the incandescent body according to the usual methods, may once again be worked in around or along the opening of the incandescent body and by way of this becomes a protective medium with the second turn. Or alternatively the binding yarn is not sewn in the incandescent body according to the usual methods. The binding yarn in the manner of a noose is sewn in around the opening of the incandescent body so that the yarn lies therebetween in the region of the incandescent body which faces the burner. It is at the same time a binding medium and protective medium.

BRIEF DESCRIPTION OF THE DRAWINGS

The invention is described by way of example by way of the drawings.

The figures of the drawings individually represent in FIG. 1 a schematic side view of the use according to the invention, of binding yarn on an incandescent body in the unfastened condition according to a first embodiment example.

DETAILED DESCRIPTION OF THE PREFERRED EMBODIMENTS

Figure 1:
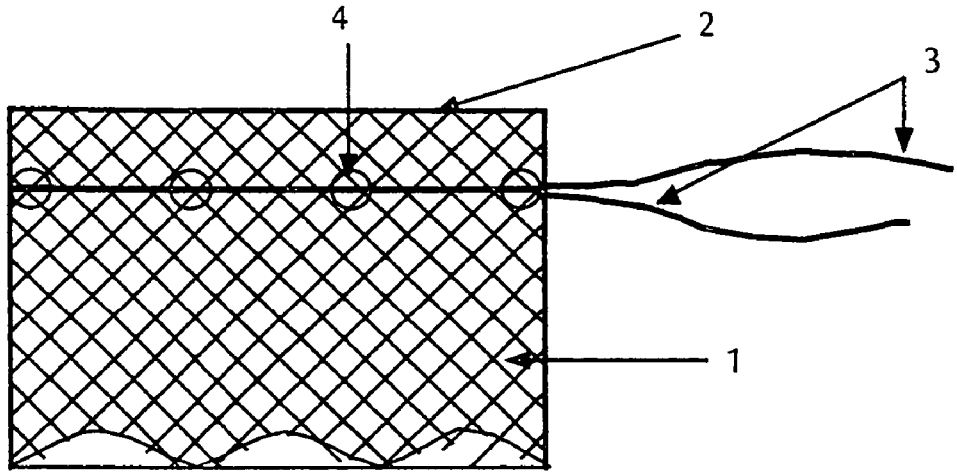
Figure 2:
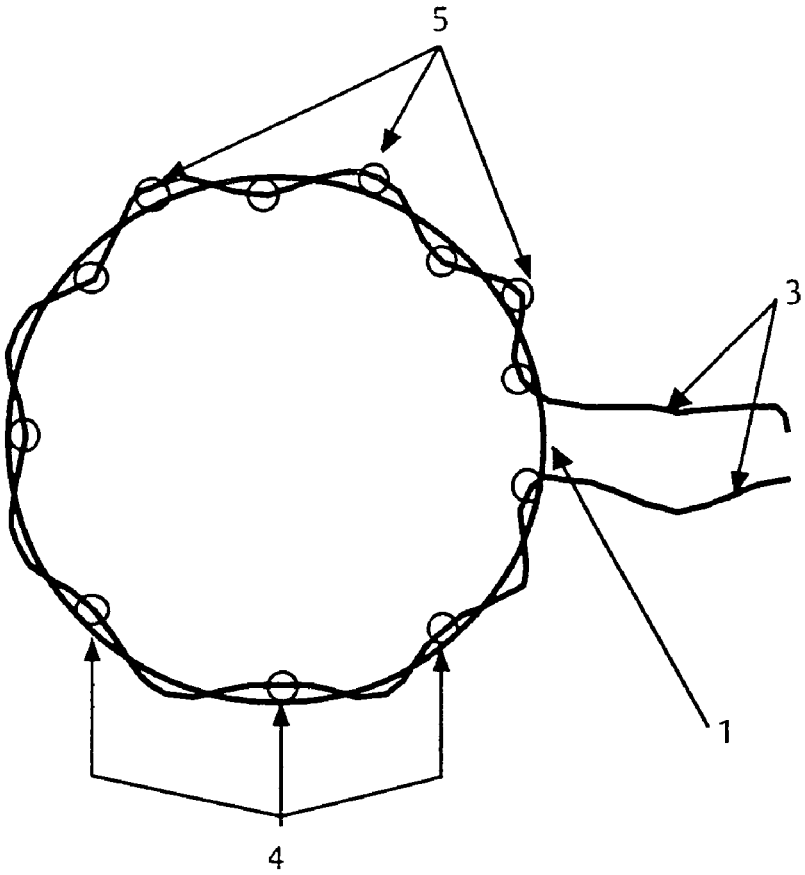
FIG. 2 is a plan view of the end of an incandescent body according to FIG. 1.

In FIGS. 1 and 2, 1 indicates the incandescent body which is firstly endlessly knitted and after a separating cut has an open end 2. At a preselected distance to the end 2, a textured binding yarn 3 is pulled through the periphery of the incandescent body such that it lies alternating on the inside and outside. Bead-like fireproof bodies 4 are pulled onto the section of the textured binding yarn lying on the inside. For this purpose these bodies have corresponding bores through which the textured binding yarn may be guided. This arrangement is preferred.

Figure 3:
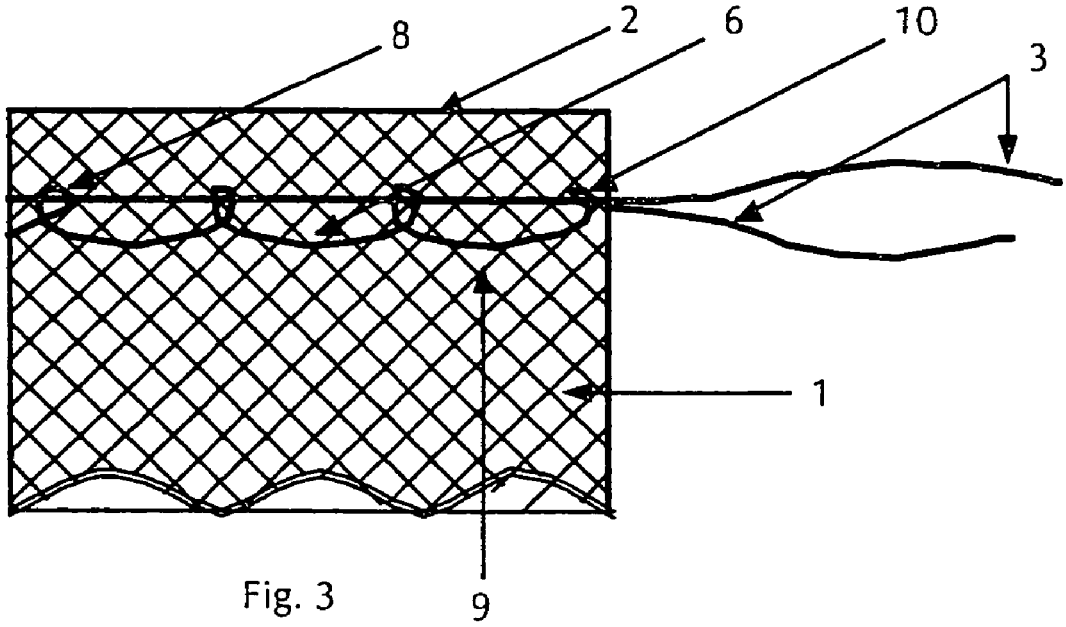
FIG. 3 is a schematic side view of the use according to the invention, of binding yarn on an incandescent body in the unfastened condition according to a second embodiment example.
Figure 4:
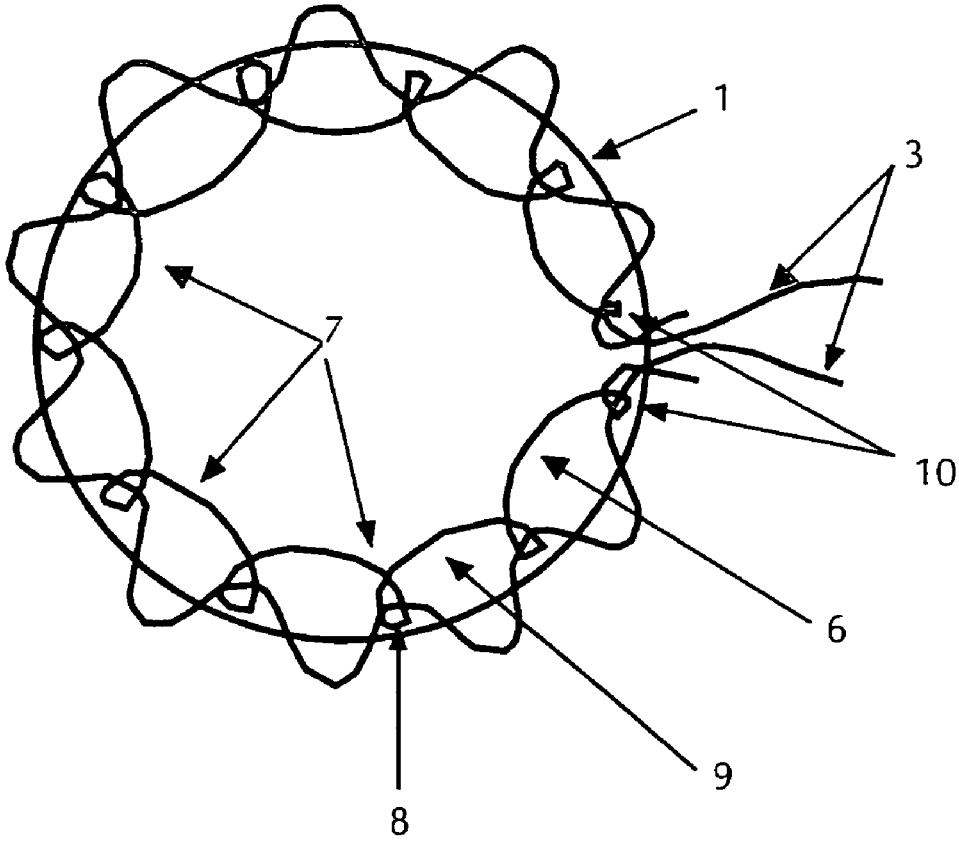
FIG. 4 is a plan view of the end of an incandescent body according to FIG. 3.

In FIGS. 3 and 4 there is shown an alternative embodiment example with which a thread 6 acts as a protective medium. The textured binding yarn as in the previously described embodiment example is led alternately through the incandescent body. The thread 6 in the inner-lying regions 7 of the textured yarn 6 is led around this in the form of a noose 8 and is thus movably fastened on the binding yarn 3. The ends of the thread 6 are fixed on the incandescent body by way of a knot 10. The thread 6 forms a loop 9 on tightening the binding yarn 3. The guiding and/or the manner of the nooses 8 may reproducibly influence the formation of the loop 9.

Figure 5:
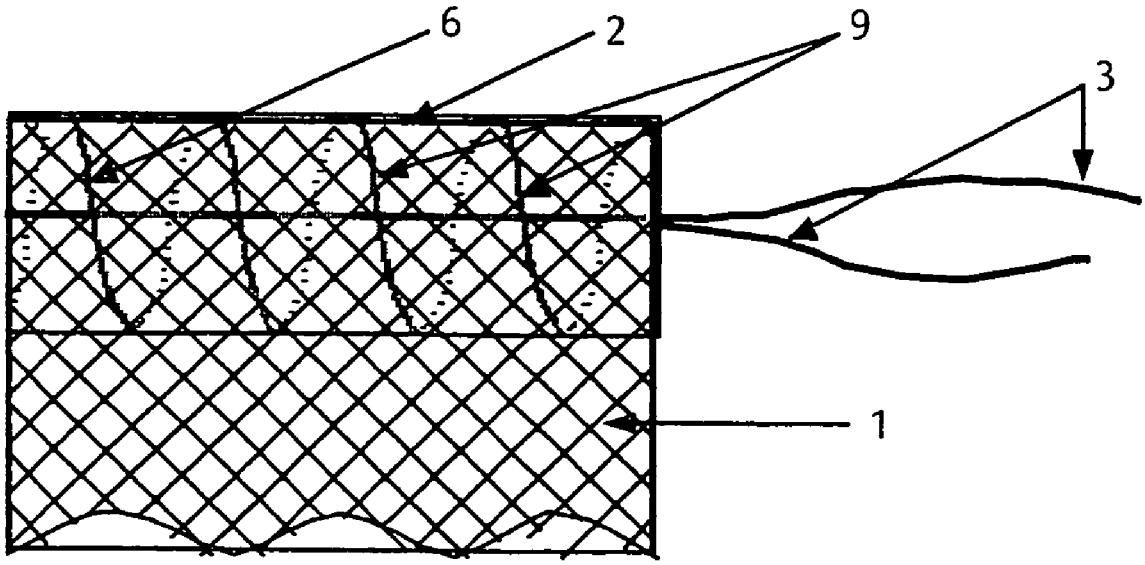
FIG. 5 is a schematic side view of the use according to the invention, of binding yarn on an incandescent body in the unfastened condition according to a third embodiment example.
Figure 6:
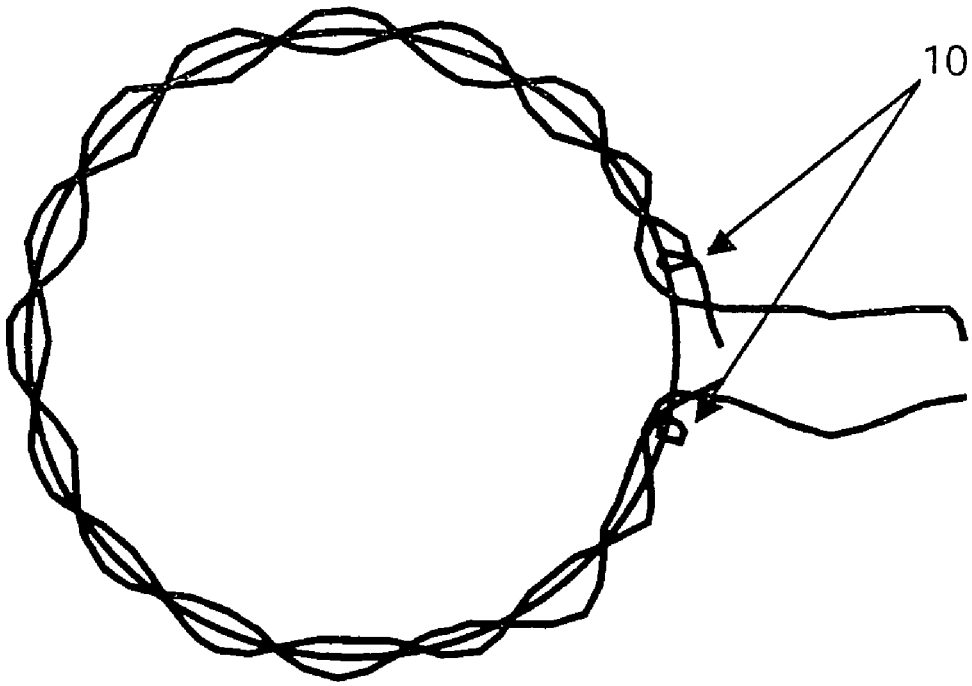
FIG. 6 is a plan view of the end of an incandescent body according to FIG. 5.

In FIGS. 5 and 6 there is shown a further embodiment example with which the thread 6 which serves as a protective medium is led in an alternating manner through the incandescent body 1 around its upper end 2. Loops 9 are formed on drawing the binding yarn 3 together which envelope the end 2 of the incandescent body 1 in the manner of a button-hole stitch. This type has a particularly long life span.

Figure 7:
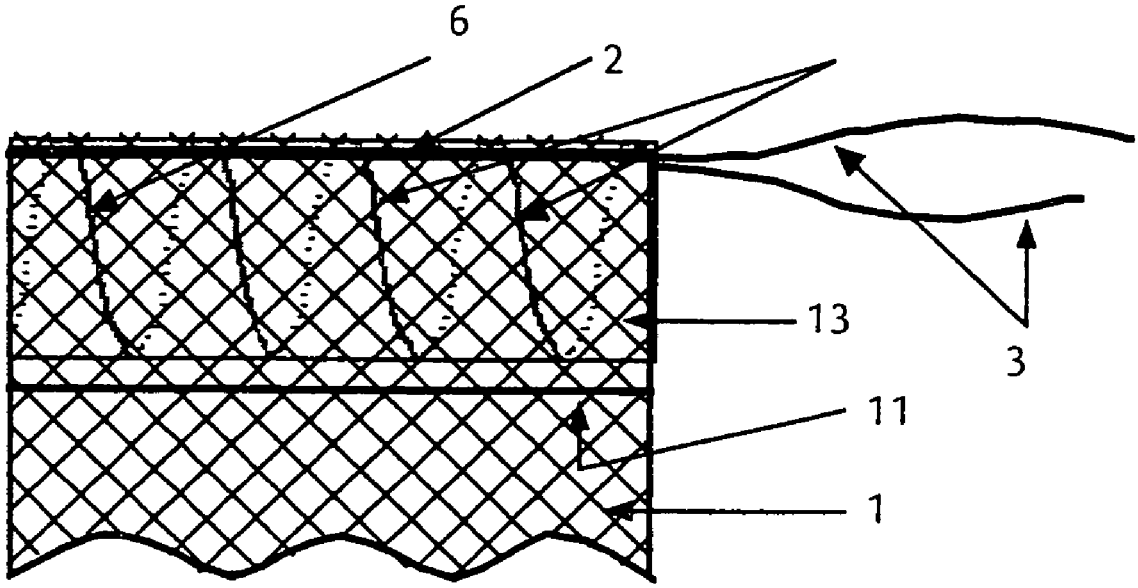
FIG. 7 is a schematic side view of the use according to the invention, of binding yarn on an incandescent body in the unfastened condition according to a fourth embodiment example.
Figure 8:
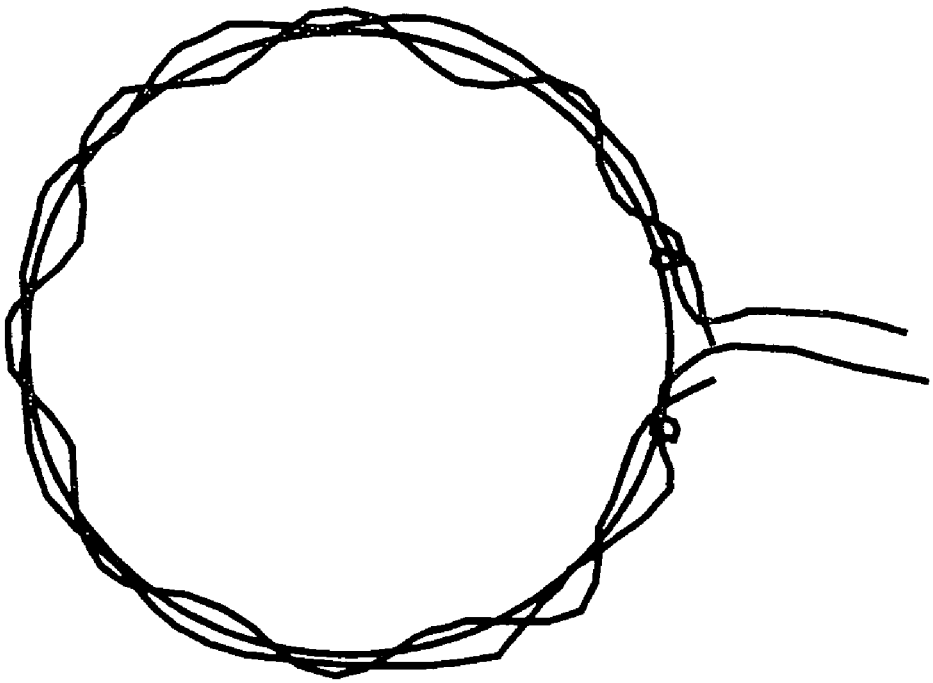
FIG. 8 is a plan view of the end of an incandescent body according to FIG. 7.

FIGS. 7 and 8 represent one variant of the design according to FIGS. 5 and 6. In contrast to the FIGS. 5 and 6, the binding yarn is not guided through the incandescent body 1, but through the upper ends of the loop 9 of the thread 6 so that the fastening of the incandescent body 1 on the burner is now effected directly by way of the thread 6. Additionally, for reinforcement of the end 2, the incandescent body is turned up so that it is two-ply in the region between the end 2 and the cut edge 11. This region may also be additionally chemically reinforced and/or colored. The turned-up region may also be knitted of fireproof material and thus represent a tissue 13 according to the invention which assumes the protective function.

Figure 9:
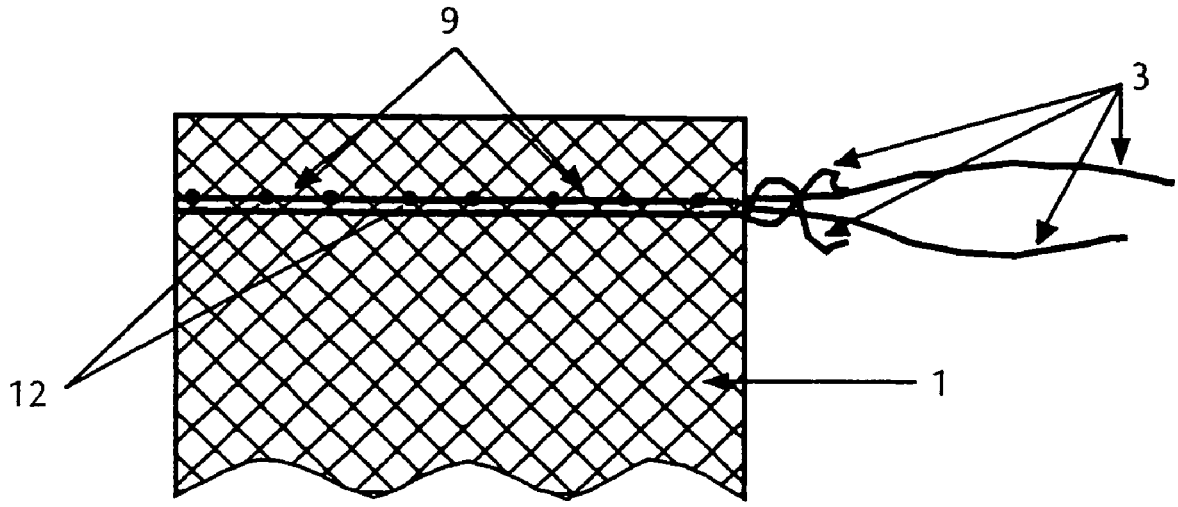
FIG. 9 is a schematic side view of the use according to the invention, of binding yarn on an incandescent body in the unfastened condition according to a fifth embodiment example.

FIG. 9 represents one embodiment example with which the binding yarn assumes the protective function as well as the binding and retaining function. In this figure the binding yarn 3 is applied double around the periphery of the incandescent body and led through it several times in an alternating manner. On the course of a turn it is firmly connected to the incandescent body at several locations 12 whilst on the course of the second turn it penetrates the incandescent body in a displaceable manner. On tightening the binding yarn it therefore forms loops on course with the fastening locations.

The incandescent body which is processed in the region of the burner according to the method described above by way of a textured binding yarn, has a considerably higher durability if it is subjected to knocks, impacts and vibrations. Incandescent body manufactured according to the invention in the region of the burner, alternatively to traditional processing methods, i.e. the knocking-in of the incandescent body, may be processed without significant losses in the durability so that the incandescent body tissue lies double on the burner and the binding yarn is sewn through the tissue layers, is processed as follows:

a. The incandescent body tissue is turned up in the known manner, the textured binding yarn is however only sewn through one incandescent body tissue layer of choice (depending on the nature of the burner). The sewing of the binding medium may be carried out more quickly and simply in this manner.

b. The incandescent body tissue is no longer turned up, and the binding medium is only sewn through one incandescent body tissue ply. The sewing of the binding medium may be carried out more quickly and simply.

c. The introduction of the binding medium may be carried out more simply, more quickly and with a perfect regularity in that the binding medium on the knitting machine in the knitting procedure of the substrate material (usually viscose) from which the incandescent body is manufactured and transversely to the knitting direction is introduced at the location which is fastened on the burner. This binding medium which has been co-knitted in, is subjected without damage to the further processing of the knitted product until the finished incandescent body. The binding medium which is co-knitted in such a manner may be handled in the same manner as the binding yarn which is sewn in the traditional way and manner with more or less many stitches, in order to attach the incandescent body onto the burner.

Figure 10:
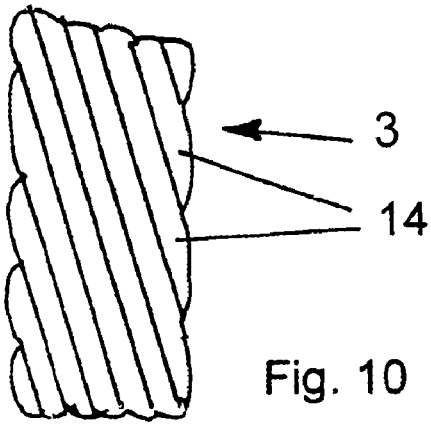
FIG. 10 is a plan view of the yarn according to the invention, according to a first embodiment.

In FIG. 10, 3 represents the binding yarn according to the invention which consists of a number of fireproof fibers 14 which are twisted with one another and whose surface has been roughened by way of an etching process. Such a yarn after the separation avoids a shrinkage in diameter and despite this may be easily knotted.

Figure 11:
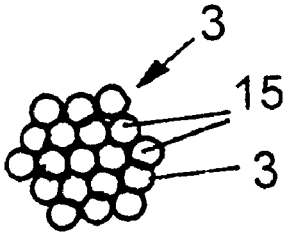
FIG. 11 is a cross section through the yarn according to FIG. 10.

Fibers of a combustible material 15 may additionally be added if their share and diameter is selected such that after burning-away, the diameter loss remains below the value according to the invention, as is for example shown as a cross section in FIG. 11.

Figure 12:
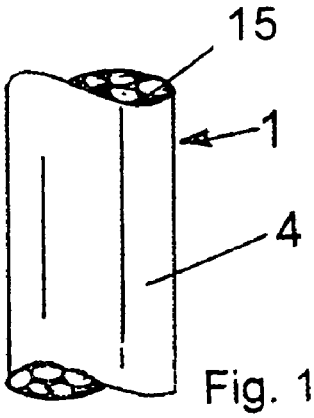
FIG. 12 is a view of the yarn according to the invention according to a second embodiment.
Figure 13:
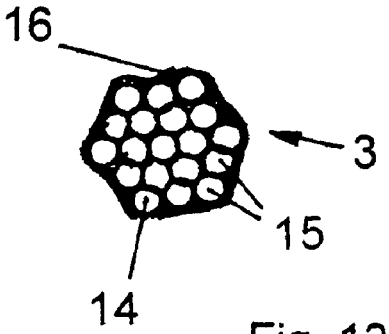
FIG. 13 is a cross section through the yarn according to FIG. 12.

In FIG. 13 as a cross section and in FIG. 12 as a schematic view there are shown the fibers 14, and if desired, combustible fibers 15 embedded or encased in a matrix 16 of a polymer. This envelope only insignificantly increases the diameter. Hardly any loss in diameter takes place on burning-away.

Figure 14:
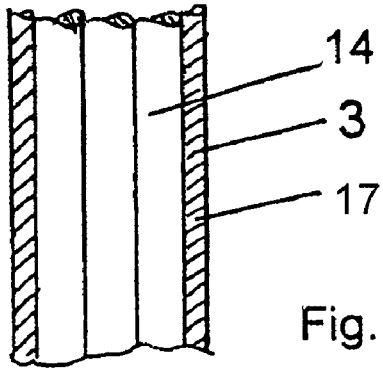
FIG. 14 is a plan view of the yarn according to the invention according to a third embodiment.
Figure 15:
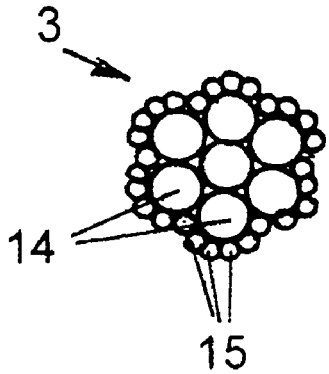
FIG. 15 is a cross section through the yarn according to FIG. 15.

FIG. 14 shows a schematic axial section and FIG. 15 the cross section to this according to a further alternative embodiment form with which a yarn of fireproof fibers 14 is surrounded by an envelope 17 of combustible fibers 15. According to the invention this envelope 17 is however designed thinner than in the state of the art. In order to produce a suitably thin envelope the fibers 15 are spun, woven, braided or knitted around the core, that is to say around the inner fireproof fibers 14.

Figure 16:
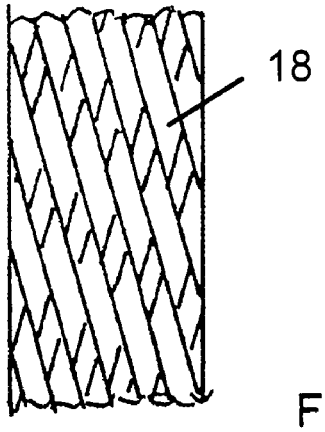
FIG. 16 is a plan view of the yarn according to a further alternative embodiment.

However, as is shown in FIG. 16 as a schematic view, the fireproof fibers may be directly spun, woven, braided or knitted with themselves into a yarn so that by way of the structure which arises from the process there arises a sufficiently rough surface 18 which makes the yarn much easier to knot and on burning-away has no diameter loss. One may completely do away with combustible fibers.

What is claimed is:

1. In an asbestos-free binding yarn for a knotted fastening of incandescent bodies to burners of incandescent lamps, whose incandescent bodies, after the fastening, are subjected to a flame, the improvement comprising:

an incandescent body having an open end adapted for engagement to a burner of an incandescent lamp;

a binding yarn forming a drawstring, said drawstring providing means for cinched engagement of said open end of said incandescent body to said burner;

said binding yarn composed of fireproof material having a diameter change of less than 50% of its original diameter, after exposure in said flame.

2. The binding yarn according to claim 1 additionally comprising:

said fireproof material being substantially silica.

3. The binding yarn according to claim 1, characterized in that the yarn consists of a fireproof material which is knitted, braided or spun with itself.

4. The binding yarn according to claim 2, characterized in that the yarn consists of a fireproof material which is knitted, braided or spun with itself.

5. The binding yarn according to claim 1, further comprising said binding yarn being textured to thereby improve knotting employed in said knotted fastening.

6. The binding yarn according to claim 2, further comprising said binding yarn being textured to thereby improve knotting employed in said knotted fastening.

7. The binding yarn according to claim 3, further comprising said binding yarn being textured to thereby improve knotting employed in said knotted fastening.

8. The binding yarn according to claim. 4, further comprising said binding yarn being textured to thereby improve knotting employed in said knotted fastening.

9. The binding yarn according to claim 1, further comprising said binding yarn having an etched surface to thereby improve knotting employed in said knotted fastening.

10. The binding yarn according to claim 2, further comprising said binding yarn having an etched surface to thereby improve knotting employed in said knotted fastening.

11. The binding yarn according to claim 3, further comprising said binding yarn having an etched surface to thereby improve knotting employed in said knotted fastening.

12. The binding yarn according to claim 4, further comprising said binding yarn having an etched surface to thereby improve knotting employed in said knotted fastening.

13. The binding yarn according to claim 1 additionally comprising: characterized in that it is said binding yarn enveloped by a layer of combustible material.

14. The binding yarn according to claim 2 additionally comprising: characterized in that it is said binding yarn enveloped by a layer of combustible material.

15. The binding yarn according to claim 3 additionally comprising: characterized in that it is said binding yarn enveloped by a layer of combustible material.

16. The binding yarn according to claim 4 additionally comprising: characterized in that it is said binding yarn enveloped by a layer of combustible material.

17. The binding yarn according to claim 13 wherein said layer of combustible material is a polymer.

18. The binding yarn according to claim 14 wherein said layer of combustible material is a polymer.

19. The binding yarn according to claim 1, wherein said binding yarn consists from 2 to 3 twisted fiber strands which have a length-related may of substantially 170 Tex per fibre strand.

20. The binding yarn according to claim 2, wherein said binding yarn consists from 2 to 3 twisted fiber strands which have a length-related may of substantially 170 Tex per fibre strand.

* * * * *